United States Patent [19]

Embree

[11] 4,051,895

[45] Oct. 4, 1977

[54] POSITIONING TOOL

[75] Inventor: Hugh D. Embree, Lafayette, La.

[73] Assignee: Production Specialties, Inc., Lafayette, La.

[21] Appl. No.: 705,144

[22] Filed: July 14, 1976

[51] Int. Cl.[2] ..... E21B 7/06

[52] U.S. Cl. ..... 166/117.5

[58] Field of Search ..... 166/117.5

[56] References Cited

U.S. PATENT DOCUMENTS

| | | | |
|---|---|---|---|
| 2,948,341 | 8/1960 | Fredd | 166/332 |
| 3,788,397 | 1/1974 | Terral et al. | 166/117.5 |
| 3,827,490 | 8/1974 | Moore, Jr. et al. | 166/117.5 |
| 3,889,748 | 6/1975 | Tausch | 166/117.5 |
| 3,891,032 | 6/1975 | Tausch et al. | 166/117.5 |

*Primary Examiner*—James A. Leppink
*Attorney, Agent, or Firm*—Jack W. Hayden

[57] ABSTRACT

A positioning tool for use in placing a valve or removing a valve selectively from a mandrel in a tubing string includes an elongated cylindrical body member with an elongated plunger telescopically and nonrotatably arranged therein. Spring means abuts spaced shoulder means on the body member and elongated plunger to tend to urge the plunger and body member into abutting relationship adjacent their upper ends. A guide key is pivotally mounted on the body member by a shear pin and projects outwardly of a slot in the body member so that it may be engaged with a shoulder of an orientation sleeve mounted in the tubing string to align the positioning tool relative to a desired mandrel for placing a valve therein or removing a valve therefrom. A shifting tool is pivotally supported by the plunger and adapted to support a valve to be positioned in the mandrel and cooperating means on the plunger and shifting tool retain the plunger and shifting tool axially aligned in the main bore but is operable on movement of the plunger relative to the body member for shifting the shifting tool means into the mandrel for positioning the valve therein. After the valve has been positioned in the mandrel the positioning tool may be realigned axially in the tubing string to enable it to be more readily withdrawn from the tubing.

5 Claims, 7 Drawing Figures

POSITIONING TOOL

SUMMARY OF THE INVENTION

Various devices have been proposed and are in use at the present time for placing valves in and removing valves from the side pocket of a mandrel in a tubing string. It is desirable after the valve has been positioned in the mandrel that the positioning tool assume a relationship in the tubing of the well bore so that it can be readily withdrawn therefrom with a minimum of contact between the positioning tool and the tubing to inhibit wear and tear on the positioning tool as well as inhibiting damage to the tubing.

An object of the present invention is to provide improvement in the form of tool illustrated in U.S. Pat. No. 2,948,341.

Yet a further object of the present invention is to provide a running or positioning tool for positioning a vlave in a side pocket mandrel which is constructed and arranged to lock the positioning tool in axial relationship as it is lowered into the tubing, but which may be manipulated to shift into alignment with the side pocket of a mandrel for placing a valve therein and thereafter axially realign for removal from the well bore.

Yet a further object of the present invention is to provide a running or positioning tool for positioning a valve in a side pocket mandrel which is constructed and arranged to lock the positioning tool in axial relationship as it is lowered into the tubing, but which may be manipulated to shift into alignment with the side pocket of a mandrel for placing a valve therein and thereafter axially realigned for removal from the well bore, the running tool being constructed and arranged so that it can also be locked in alignment with the side pocket portion of the mandrel during placing of the valve therein.

Other objects and advantages of the present invention will become more readily apparent from a consideration of the following description and drawings.

DESCRIPTION OF THE PREFERRED EMBODIMENT

Figure 1:
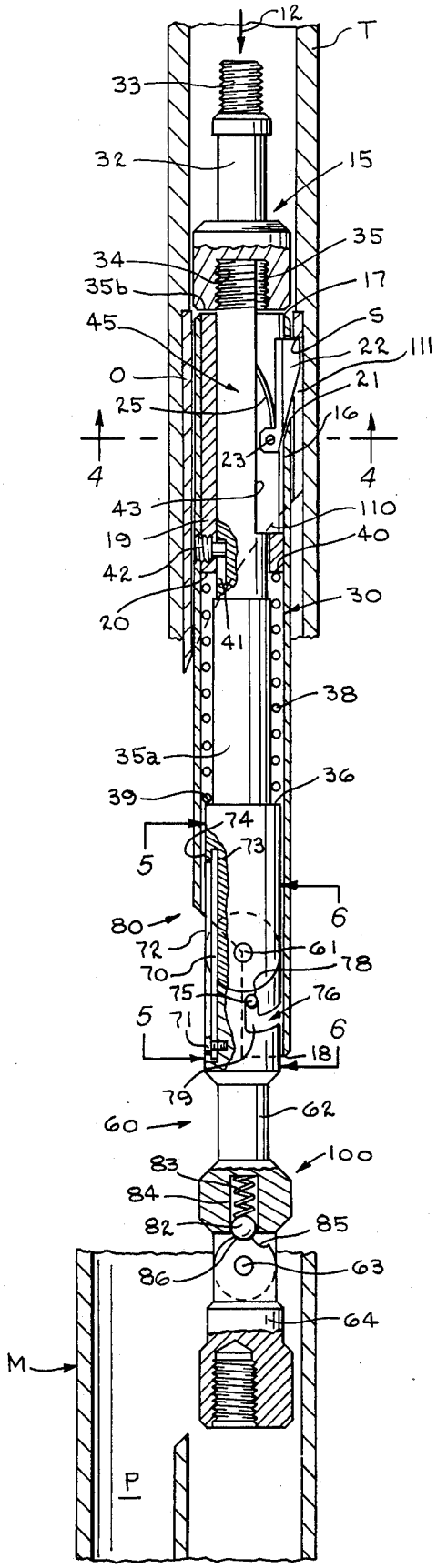
FIG. 1 is a sectional view of the tool of the present invention illustrating its arrangement as it is lowered in a well tubing adjacent a mandrel with a side pocket therein.

Attention is first directed to FIG. 1 of the drawings wherein a well tubing is illustrated by the letter T and the present invention therein which is represented generally by the numeral 15. The present invention may be lowered into the well tubing as represented by the arrow 12 by any suitable means such as a wire line, cable or the like. It includes a cylindrical body member referred to generally at 30 having an elongated plunger referred to generally at 45 telescopically and nonrotatably arranged therein.

The cylindrical body member 30 includes the tubular housing 16 which extends from its upper end 17 to its lower end represented at 18. A tubular insert 19 is provided adjacent the upper end 17 of the tubular housing 16 and provides a shoulder 20 internally of the tubular housing 16 as shown. A slot 21 is formed in the tubular housing 16 and a guide key 22 is pivotally mounted on the tubular housing 16 by the shear pin 23 adjacent the lower end thereof. Spring means 25 in the form of a leaf spring engages the key 22 and the plunger 45 to urge the key 22 outwardly of the tubular housing 16 as shown in FIG. 1 of the drawings.

The guide key 22 projects outwardly through the slot 21 and outwardly of the tubular housing 16 so that it can engage with the shoulder S of the orientation sleeve referred to by the letter O which is positioned in and forms part of the tubing for a purpose as will be described in greater detail hereinafter. The elongated plunger 45 includes a cap 32 which is provided with a threaded upper end 33 for engagement with the running string and a threaded bore 34 for engaging with the threaded upper end 35 of the rod **35*a* as shown in the drawings. The cap 32 terminates at 35*b* which provides a shoulder for abutting the upper end 17 of the tubular housing 16** as the device is run into the well.

A shoulder 36 on the rod **35*a* of plunger means 45 is spaced from the shoulder 20 formed on the tubular housing 16 and a spring 38 has one end 39 resting on the shoulder 36 and the other end 40 abutted against the shoulder 20 so as to tend to urge the upper end 17 of the tubular member 30 into engagement with the end 35 of the cap 32 forming the upper part of the plunger 45**.

Figure 3:
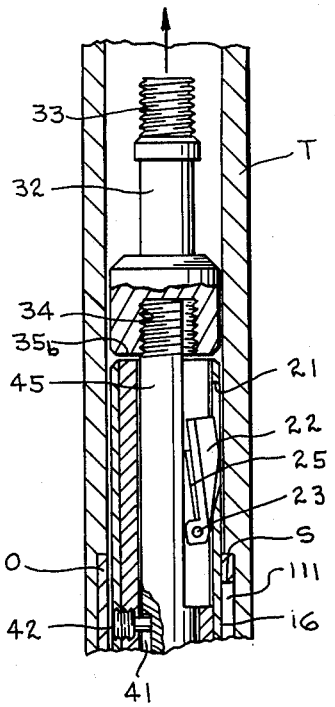
FIG. 3 is a sectional view of the upper portion of the tool showing the relationship of certain components after the tool has been actuated and is ready to be retrieved from the tubing.
Figure 4:
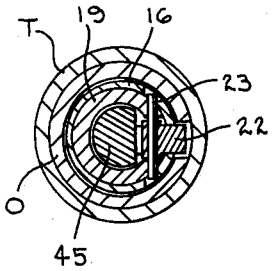
FIG. 4 is a sectional view on the line 4—4 of FIG. 1.
Figure 5:
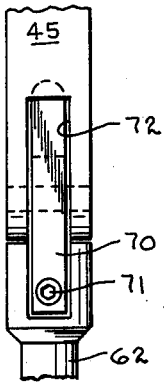
FIG. 5 is a view on the line 5—5 of FIG. 1 illustrating the spring means and its structural relationship between the shifting tool and plunger of the present invention.
Figure 6:
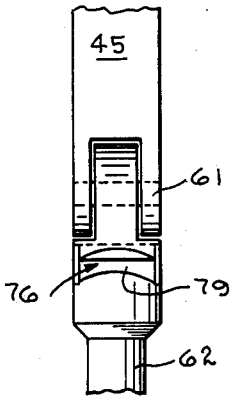
FIG. 6 is a view on the opposite side of the tool from FIG. 5 to show a portion of the slot means.

A slot 41 formed in the rod **35*a* of the plunger 45 receives the key or pin 42 which is secured in the tubular housing 16 to accommodate longitudinal relative movement between the plunger 45 and tubular member 30 while inhibiting relative rotation therebetween. The elongated rod 35*a* of plunger means 45 is cut away as illustrated at 43 adjacent the guide key 22 so that after the pin 23 has been sheared, the guide key 22 may be retracted internally of the tubular housing 16** as the device is pulled up the well tubing T as illustrated in FIG. 3 of the drawings.

Figure 7:
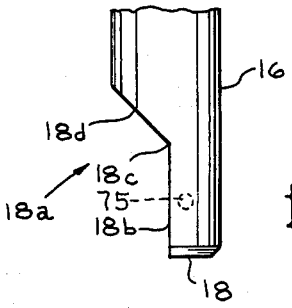
FIG. 7 is a partial elevational view of the lower end of the cylindrical body member.

The lower end 18 of the tubular housing 16 and its configuration is better illustrated in FIG. 7 of the drawings and is shown as including a cut away portion referred to generally at **18*a* which is defined by a line 18*b* extending longitudinally which terminates at 18*c* and intersects the outwardly tapering edge 18*d* of the cut away portion 18. This enables the shifting tool means referred to generally by the numeral 66 to move outwardly of the tubular housing 16** and into the side pocket portion P of the mandrel M which is partially illustrated in FIG. 1 of the drawings.

Cooperating means referred to generally at 80 are provided on the plunger means 45 and the shifting tool means 60 to retain the plunger means 45 and shifting tool means 60 axially aligned in the main bore of the tubing string, which means are operable on movement of the plunger means 45 relative to the tubular housing 16 for shifting of the shifting tool means 60 into the side pocket P. The shifting tool means 60 is pivotally connected at 61 to the lower end of the plunger means 45 and includes a primary arm 62 which depends from the lower end of rod 35*a* of plunger means 45 as shown in FIG. 1 of the drawings. The primary arm 62 is pivotally connected at its lower end at 63 to the secondary arm 64 and cooperating spring loaded plunger and detent means referred to at 100 are provided between the primary arm 62 and secondary arm 64 for a purpose as will be described. The cooperating means 80 on the plunger means 45 and shifting tool means 60 includes the leaf spring means 70 secured by any suitable means such as the bolt 71 threaded through the lower end thereof and into primary arm 62 as shown. The leaf spring 70 is arranged in longitudinally extending recess 72 formed at the upper end of primary arm 62 and lower end of rod 35*a* of plunger means 45 and is of suitable width for receiving the leaf spring 70. It will be noted that the recess 72 is provided with an undercut portion 73 adjacent the upper end thereof to form an overhanging ledge 74 for retaining the upper end of the leaf spring engaged with the plunger.

A pin 75 shown as mounted adjacent the lower end 18 of tubular housing 16 and fits within the slot means referred to generally at 76. The slot means 76 is formed on the shifting tool means 60 and includes a vertically extending portion 77 having the closed upper end 78, such slot portion 77 intersecting at its lower end the laterally extending slot portion 79 which laterally extending slot extends outwardly and slightly upwardly to the edge 81 of the primary arm 62.

The spring loaded plunger and detent means 100 between the primary arm 62 and secondary arm 64 is formed by the ball 82 which is secured to the spring 83 received in recess 84 formed in the lower end of primary arm 62 as shown. A pair of detents 85 and 86 are formed in the upper end of secondary arm 64 for receiving the ball 82 therein.

Figure 2:
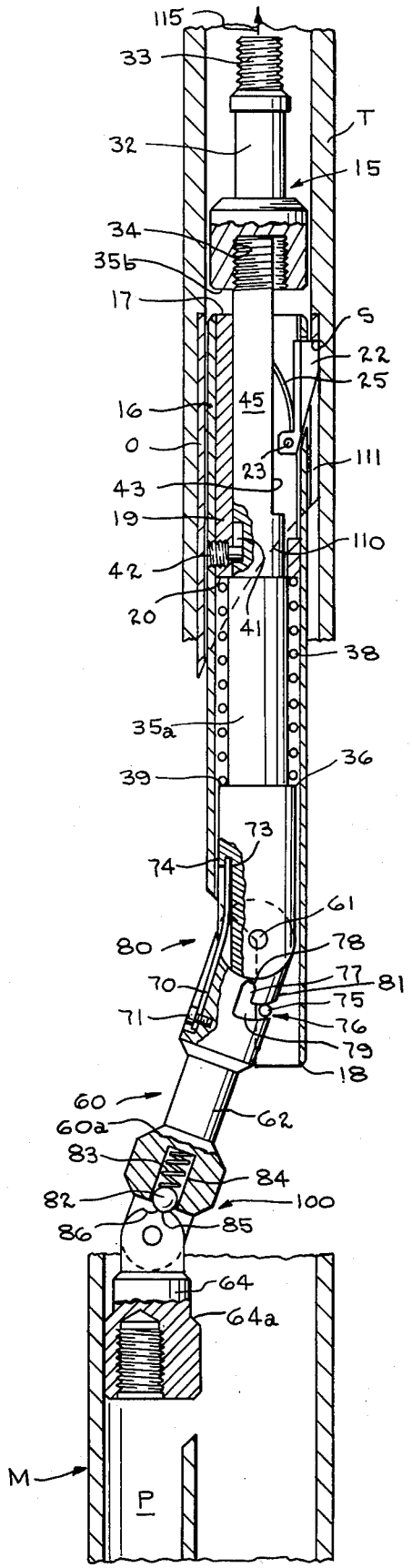
FIG. 2 is a sectional view showing the tool of the present invention after it has been actuated for alignment with the side pocket of the mandrel for placing a valve therein.

When the tool is in the position as shown in FIG. 1 of the drawings and is being lowered into the tubing string T, the pin 75 is positioned in the vertical slot portion 77 having the closed end 78 and thus holds the plunger means 45 axially aligned with the shifting tool means 60. The leaf spring 70 tends to urge the shifting tool means 60 laterally relative to the longitudinal axis of the plunger means 45 as illustrated in FIG. 2 of the drawings; however, until an upward strain has been taken on the lowering string after the guide key 22 is engaged with the shoulder S of the orientation sleeve 0 to pull the plunger means 45 upwardly relative to the upper end 17 of the tubular housing 16 as shown in FIG. 2 of the drawings, only then does the pin 75 and slot means 76 move relative to each other so that the pin 75 can assume a position to move into the laterally formed slot 79 as shown in FIG. 2 of the drawings. When the pin 75 is aligned with the laterally extending slot portion 79 at the lower end of slot portion 77 the leaf spring 70 then moves to its normally bent position as illustrated in FIG. 2 so as to cock or move the primary arm 62 laterally of the longitudinal axis of the plunger means 45 as shown in FIG. 2 of the drawings.

When this occurs the shifting tool 60 is moved into the side pocket portion P of the mandrel M as illustrated in FIG. 2 of the drawings and this moves lateral slot 79 to position it relative to pin 75 as shown in FIG. 2. Also, the secondary arm 64 engages the wall of the mandrel at the side pocket portion P and such engagement causes the secondary arm 64 to pivot about pivot 63 so that it in turn aligns with the side pocket portion P of the mandrel M as shown in FIG. 2 of the drawings for placing a valve therein.

While it is believed that the operation of the present invention is apparent from the foregoing description, it will be assumed that the present invention has been lowered into a tubing string T as shown in FIG. 1 of the drawings having an orientation sleeve O which has the caming surface 110 adjacent its lower end that communicates with a longitudinally extending slot 111 in the sleeve O. The orientation sleeve O is positioned in the tubing string T so that when the present invention is lowered into the tubing string T and then guide key 22 engaged with the caming surface 110 and moved into the slot 111, the shifting tool means 60 and the present invention will be properly aligned relative to the side pocket mandrel M for placing a valve therein. The guide key 22 and caming surface 110 cooperate when engaged to rotate the present invention in the tubing string T to accomplish such alignment and by pulling up on the wire line or other arrangement which supports the present invention in the tubing string T, the guide key 22 is moved upwardly in the slot 111 until it engages the shoulder S as shown in FIG. 2.

A further upward strain as represented by the arrow at 115 pulls the plunger means 45 upwardly while the cylindrical housing 16 remains stationary thus moving the pin 75 down slot portion 77 whereupon the leaf spring 70 flexes and moves the shifting tool means 60 as illustrated in FIG. 2 of the drawings to move slot portion 79 relative to pin 75. As the primary arm 62 and secondary arm 64 shift towards the side pocket P the secondary arm 64 will engage the side of the mandrel M in the side pocket portion and will move the ball 82 from detent 86 to detent 85. This helps maintain secondary arms 64 aligned with the side pocket P as the tool is then lowered and the valve placed in the side pocket portion. The valve (not shown) is then positioned in the side pocket P and the present invention disengaged therefrom by means well known in the art forming no part of the present invention.

After the valve has been seated, it is then desired to retrieve the present invention to the earth's surface. Further upward strain on the mechanism which supports the present invention in the tubing string T with the key 22 engaged in the slot 111 against the shoulder S shears pin 23 whereupon key 22 may retract into the cylindrical housing 16 as shown in FIG. 3 of the drawings, as the present invention is moved upwardly in the well string T. As the tool 15 is raised, the enlargement 60*a* on primary arm 62 reaches the smaller diameter of the tubing T, relative to side pocket mandrel M, and is forced inwardly to realign shifting tool means 60 and plunger means 45 and reposition pin 75 in alignment with slot portion 77. When the realignment occurs, the end 17 of body 30 will reengage the end 35 of the plunger means 45 due to the force of spring 38. As the end 17 moves towards the end 35 of the plunger the pin 75 will be moved upwardly in closed end slot portion 77 to reassume the position shown in FIG. 1 of the drawings. This will maintain axial alignment of the primary arm of the shifting tool means 60 with the plunger means 45 as continued upward movement of the present invention through the well string is effected. As the tool 15 is continued to be moved up in the tubing string T, the enlargement 64*a* on the secondary arm 64 engages the tubing T at its juncture with the mandrel M and this forces the secondary arm 64 to also axially align with the primary arm 62 so that the ball 82 then reengages in detent 86 and is thus locked in axial position for removal from the well bore.

From the foregoing invention, it can be seen that the present arrangement enables the present invention to remain locked axially so that it can be lowered through the tubing string T with a minimum of effort and then positioned adjacent a mandrel M. As the tool is actuated as described hereinabove, it will be locked in alignment with the valve receiving section in the side pocket P of the mandrel M to enable a valve to be deposited therein by means well known in the art.

Thereafter the present invention is manipulated as described hereinabove so that it relocks in axial alignment to enable it to be withdrawn from the tubing string T with a minimum of effort.

The foregoing disclosure and description of the invention are illustrative and explanatory thereof, and various changes in the size, shape, and materials as well as in the details of the illustrated construction may be made without departing from the spirit of the invention.

What is claimed is:

1. A well valve handling apparatus for use in placing a valve in or removing a valve from a well tubing having a plurality of tubing mandrels each having a main bore therethrough and a side pocket offset from the main bore and including an orientation sleeve mounted in the main bore having a longitudinal orientation slot and a shoulder therein comprising:

a. an elongated cylindrical body member;
b. an elongated plunger telescopically and nonrotatably arranged in said body member;
c. spring means abutting spaced shoulder means on said body member and elongated plunger to tend to urge said elongated plunger and body member into abutting relation adjacent their upper ends;
d. a guide key pivotally mounted on said body member by a shear pin;
e. said body member having a slot therein through which said guide key means projects outwardly from said body member;
f. spring means yieldably urging said guide key means outwardly of said body member for engagement in the longitudinal orientation slot of the desired mandrel while allowing said guide key means to downwardly bypass sleeves above the desired location;
g. shifting tool means pivotally supported by said plunger and adapted to support a valve to be positioned in the side pocket; and
h. cooperating means on said body member and shifting tool means to retain said plunger and shifting tool means axially aligned in the main bore but operable on movement of said plunger relative to said body member for shifting said shifting tool means into the side pocket.

2. The invention of claim 1 wherein said shifting tool means includes:

a. a primary arm pivotally supported at one end by said plunger means;
b. a secondary arm pivotally supported at the other end of said primary arm; and
c. cooperating spring loaded plunger means and detent means on said primary and secondary arm to retain said primary and secondary arm aligned in the main bore and to retain said secondary arm aligned with the side pocket when said shifting tool means is shifted into the side pocket.

3. The invention of claim 1 wherein said cooperating means includes:

a. cooperating pin and slot means on said body member and plunger to maintain said plunger and body member axially aligned when said plunger and body member are in abutting relationship, said pin and slot movable relative to each other when said plunger is moved relative to said body member; and
b. additional spring means acting between said plunger and shifting tool means for shifting said shifting tool means into the side pocket when said pin and slot are in a predetermined relative position.

4. The invention of claim 3 wherein said shifting tool means includes:

a. a primary arm pivotally supported at one end by said plunger means;
b. a secondary arm pivotally supported at the other end of said primary arm; and
c. cooperating spring loaded plunger means and detent means on said primary and secondary arm to retain said primary and secondary arm aligned in the main bore and to retain said secondary arm aligned with the side pocket when said shifting tool means is shifted into the side pocket, said cooperating means and cooperating spring loaded plunger and detent means aligning said shifting tool means and plunger when said shear pin holding said guide key against the shoulder in the orientation sleeve is sheared and the apparatus is moved from the mandrel into the tubing.

5. The invention of claim 3 wherein:

a. said pin is mounted on said cylindrical body member;
b. said slot means is formed on said shifting tool means and includes a vertical portion having a closed end and a laterally extending portion one end of which intersects said vertical portion and the other end of which is open; and
c. said spring means is a leaf spring having one end secured to said shifting tool means and the other end engaged with said plunger, said spring normally tending to urge said shifting tool out of axial alignment with said plunger.

* * * * *

UNITED STATES PATENT AND TRADEMARK OFFICE

CERTIFICATE OF CORRECTION

PATENT NO. : 4,051,895

DATED : October 4, 1977

INVENTOR(S) : Hugh D. Embree

It is certified that error appears in the above-identified patent and that said Letters Patent are hereby corrected as shown below:

Col. 1, line 20, "vlave" should be --valve--

Col. 2, line 58, "66" should be --60--

Signed and Sealed this

*Twenty-seventh* Day of *December 1977*

[SEAL]

*Attest:*

RUTH C. MASON
*Attesting Officer*

LUTRELLE F. PARKER
*Acting Commissioner of Patents and Trademarks*